United States Patent [19]

Nagel et al.

[11] Patent Number: 4,949,518

[45] Date of Patent: Aug. 21, 1990

[54] SPACE-DIVIDING WALL PANEL

[75] Inventors: Russell A. Nagel, Ada; Paul R. Walker, Hudsonville, both of Mich.

[73] Assignee: Westinghouse Electric Corp., Pittsburgh, Pa.

[21] Appl. No.: 872,053

[22] Filed: Jun. 6, 1986

[51] Int. Cl.[5] ..... E04H 5/00

[52] U.S. Cl. ..... 52/239; 52/241; 52/309.4; 52/316

[58] Field of Search ..... 52/238.1, 239, 145, 52/309.4, 316

[56] References Cited

U.S. PATENT DOCUMENTS

| | | | |
|---|---|---|---|
| 4,021,973 | 5/1977 | Hegg et al. | 52/239 X |
| 4,083,160 | 4/1978 | MacDonald et al. | 52/316 |
| 4,084,367 | 4/1978 | Saylor et al. | 52/145 X |
| 4,246,733 | 1/1981 | Haber | 52/309.11 |
| 4,296,579 | 10/1981 | Proud | 52/239 |
| 4,310,995 | 1/1982 | Hanna | 52/400 X |
| 4,356,672 | 11/1982 | Beckman et al. | 52/238.1 X |
| 4,391,073 | 7/1983 | Mollenkopf et al. | 52/241 |
| 4,409,768 | 10/1983 | Boden | 52/309.4 |
| 4,437,278 | 3/1984 | Thomas, Jr. | 52/239 |
| 4,446,663 | 5/1984 | Stumpf et al. | 52/239 X |
| 4,601,137 | 7/1986 | Bates | 52/239 X |

*Primary Examiner*—David A. Scherbel
*Assistant Examiner*—Creighton Smith
*Attorney, Agent, or Firm*—B. R. Studebaker

[57] ABSTRACT

A decorative, lightweight, sound absorbent, fire resistant, space-dividing wall panel for use in open office systems which includes a foamed in-place gypsum core surrounded by a metal frame and a uniform cover material covering the foam sides and substantial portion of the metal frame. The cover material is preferably a polyurethane-backed fabric and may include a relief design of a preselected geometric pattern therein.

11 Claims, 3 Drawing Sheets

SPACE-DIVIDING WALL PANEL

BACKGROUND OF THE INVENTION

This invention relates to a decorative, light-weight, sound absorbent, fire resistant, space-dividing wall panel for use in open office systems and more particularly to a wall panel having a foamed in-place gypsum foam core in some instances combined with a decorative outer cover having a textured appearance.

There is an ever increasing use of the open office plan to accommodate the increased number of office workers. The open office plan concept employs a multiple of generally interconnected free standing space-dividing wall panels to section off open areas into distinct offices or work stations. A significant portion of all new office construction is being designed to accommodate the open office plan system. Preferably, the space-dividing wall panels making up the open office plan should be fire resistant, sound absorbing but still light enough that the panels can be rearranged to accommodate changing office needs. Additionally, the aesthetic appearance of the wall panels is becoming more and more important to the users.

Most present day space-dividing wall panels include an outer frame of wood, aluminum or steel and employ either corrugated paper, wood or fiberglass padding as a core material. U.S. Pat. No. 3,895,670 discloses both a wood or paper honeycomb core while U.S. Pat. Nos. 4,310,995; 4,084,367 and 4,437,278 disclose honeycombed paper cores. Examples of space-dividing wall panels employing fiberglass batting are U.S. Pat. Nos. 4,424,654; 4,391,073; 4,213,516 and 4,296,579.

In building construction, prefabricated wall assemblies have been manufactured by the foamed in-place use of polyurethane foam as disclosed in U.S. Pat. Nos. 4,409,768 and 4,246,733. These applications are for permanent building walls and it has been found that the use of polyurethane foam in space-dividing wall panels is unsuitable. Polyurethane foam is more flammable than, as for example, fiberglass padding.

The use of unitized, laminated gypsum sheet construction in partitioning systems is disclosed in U.S. Pat. No. 4,356,672. For example, in this type construction, two gypsum face boards are equally spaced apart in a laminated type construction by a plurality of core boards. This construction recognizes the extremely fire retardant and excellent sound controlling properties of gypsum but is extremely heavy in its gypsum sheet form.

It is also well known that a soft or cushioned feel can be provided for a space-dividing wall panel by laminating foam or fiberglass padding to the inner surface of the exterior fabric layer. U.S. Pat. Nos. 4,391,073 and 4,296,579 are illustrative of the practice of providing a soft under structure to the external fabric of a spacedividing wall panel.

The manufacture of wall panels with the honeycombed paper and/or fiberglass batting cores are fairly labor intensive and hence somewhat expensive to manufacture and foamed in-place polyurethane wall panels lack the acoustical properties of the former.

SUMMARY OF THE INVENTION

The decorative, lightweight, sound absorbing, fire resistant, space-dividing wall panel of this invention employs a rectangular outer frame defining the top, bottom and side edges of the panel and includes a foamed in-place gypsum foam filler, filling the space surrounded by the outer frame and constitutes the entire panel core. A decorative cover is secured to the planar surfaces of the core and the frame. The decorative cover may include a fabric outer surface having a polyurethane backing and a relief design therein. The rectangular outer frame may be of rectangular tubular construction having a flat inner surface defining the perimeter of the space and the core, or may be C-shaped in cross-section including elongated leg portions which extend into the gypsum foam. A rigid septum may be connected to the inner surfaces of the tubular rail construction dividing the space surrounded by the outer frame in half and the foamed in-place gypsum foam fills the remainder of the space on each side of the septum.

The space-dividing wall panel of this invention employs an outer frame having top, bottom and side rails and a core material filling the space defined by the outer frame. The core material has substantially planar outer surfaces and a decorative cover material covering the planar outer surfaces of the core material has a preselected relief design therein.

BRIEF DESCRIPTION OF THE DRAWING

Many of the attendant advantages of the present invention will become more readily apparent and better understood as the following detailed description is considered in connection with the accompanying drawings in which.

DESCRIPTION OF THE PREFERRED EMBODIMENT

Figure 3:
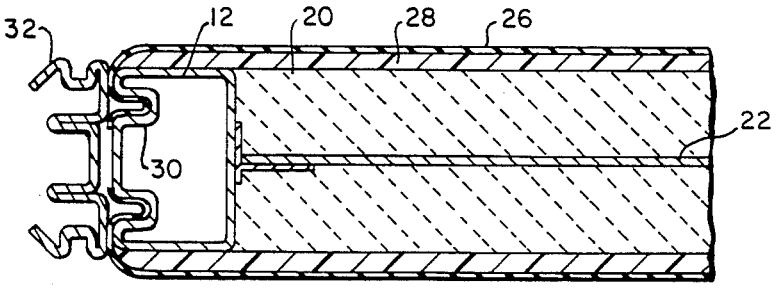
FIG. 3 is a sectional view taken along the line III—III of FIG. 1.
Figure 4:
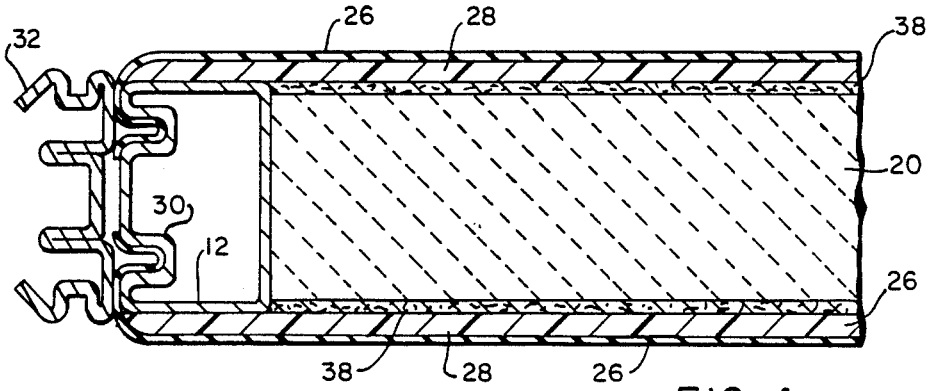
FIG. 4 is a sectional view of an alternative embodiment similar to FIG. 3.
Figure 5:
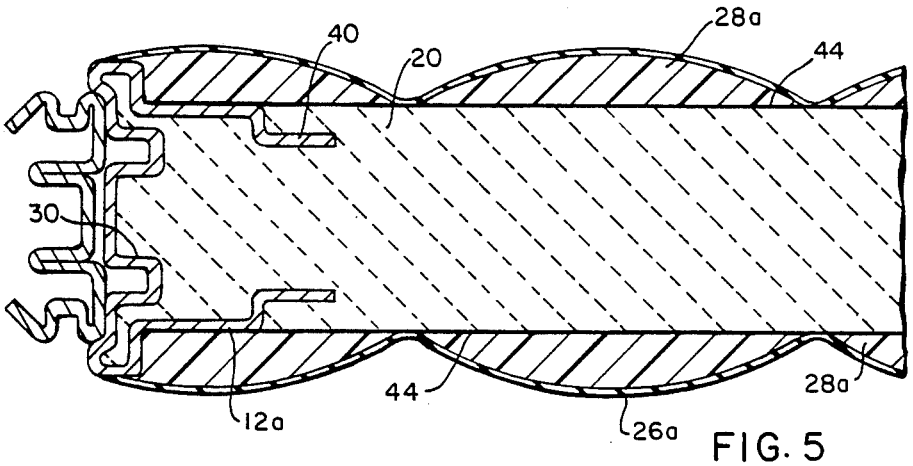
FIG. 5 is a sectional view of a third alternative embodiment similar to FIG. 3.

Referring now in detail to the drawing wherein like reference characters represent like parts throughout the several views, there is illustrated in FIGS. 1 through 5 a space-dividing wall panel constructed in accordance with the present invention. The wall panel generally designated 10 includes a tubular steel peripheral frame including a top rail 14, vertical side rails 16 and a bottom rail 18. The frame 12 may alternatively be constructed of tubular aluminum or solid wood without departing from the scope of this invention. Alternatively, the rails 14, 16 and 18 may be C-shaped in cross-section as illustrated in FIG. 5 with the opening inwardly directed. The interior core of the wall panel is formed from foamed in-place gypsum foam filler 20 which preferably may include a Surmat-fiberglass septum 22. When a septum is employed, the inner surface of the frame rails are provided with a supporting flange 24 which extends about the entire periphery of the inner surface of the frame and may be attached thereto by welding to provide additional lateral support and locating means for the septum 22.

The entire outer planar surface of the gypsum foam core along with the lateral side edges of the frame 12 are covered by a decorative fabric 26 which preferably includes a urethane foam 28 laminated to the back of the fabric to provide a soft cushioned feel to the fabric. The fabric is preferably glued to the facing 29 and outer surfaces 31 of the rails as well as in the inwardly directed channels 30 in the outer surface 31 of the frame 12. Alternatively, or additionally, the fabric may be held in place by the use of resilient grommets in the inwardly directed channels 30. Attached to the outer surface 31 of the side rails 16, by screws (not shown) or by welding, are slotted standards 32 which serve to provide support for wall-hung office equipment such as work surfaces, cabinets or the like as well as to facilitate the interconnection to adjacent space-dividing wall panels. At the bottom of the panel there is provided, secured to the bottom rail 18, a power distribution channel 34 which is described in detail in copending application Ser. No. 618,603 filed June 8, 1984 for "Panel Base Electrical Raceway" issued June 10, 1986 as U.S. Pat. No. 4,593,505, and owned by the assignee of this invention. The top rail is covered by a panel top cap 36 which may be secured to the top rail 14 by any of several conventional means.

Figure 1:
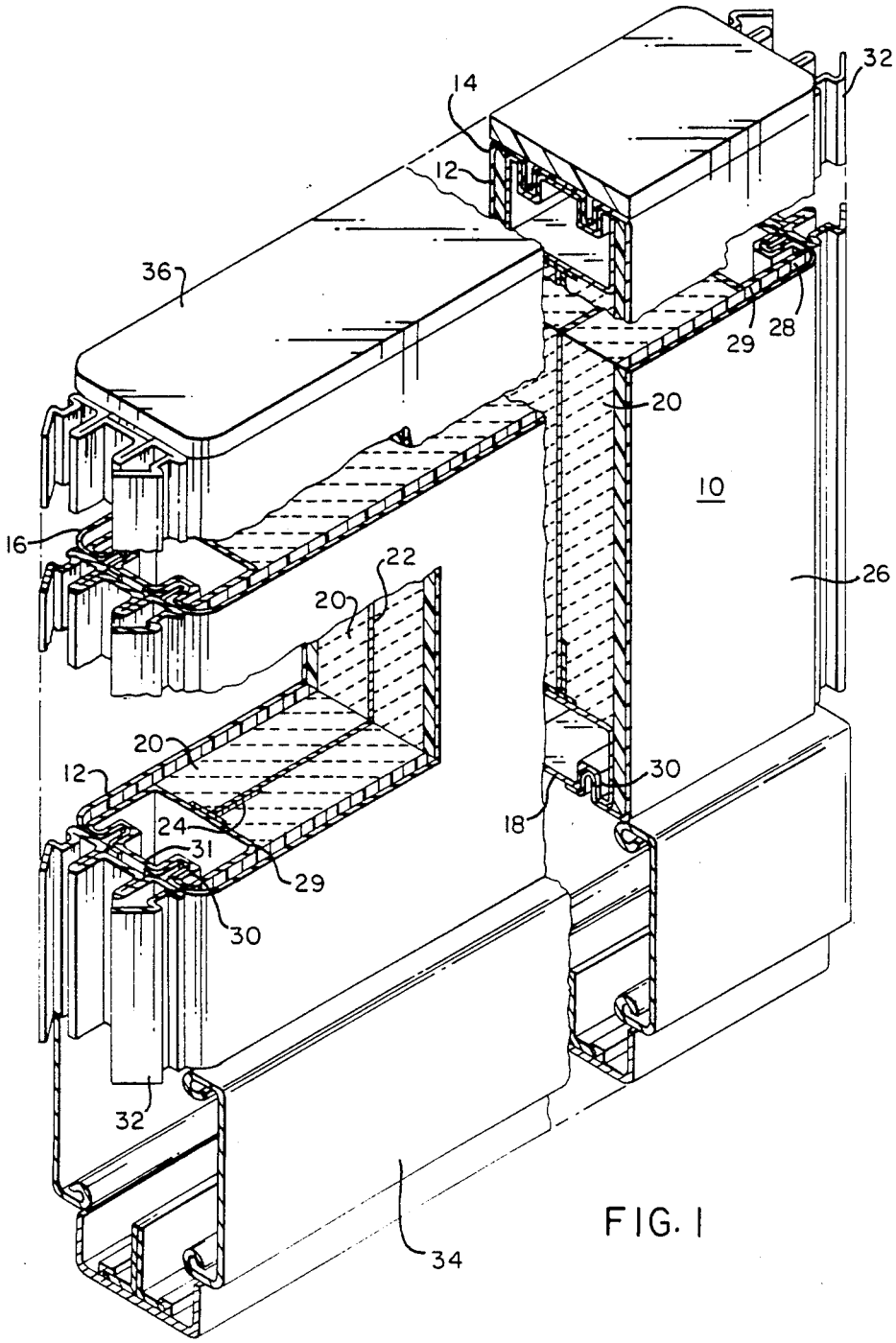
FIG. 1 is a partial perspective view partly in section of one embodiment of the space-dividing wall panel of this invention.

FIG. 4 is illustrative of an embodiment of the central core of a panel similar to that illustrated in FIGS. 1 and 3. In the FIG. 4 embodiment, the septum 22 is eliminated from the core construction and a pair of Surmat-fiberglass blankets 38 are interposed between the urethane foam-backed fabric and the foamed in-place gypsum foam filler.

The embodiment of FIG. 5 illustrates an alternative construction for the frame 12 in the form of an inwardly open C-shaped member **12*a* which includes elongated inwardly projecting legs 40 which are in part surrounded by the foamed in-place gypsum foam filler 20**.

Figure 2:
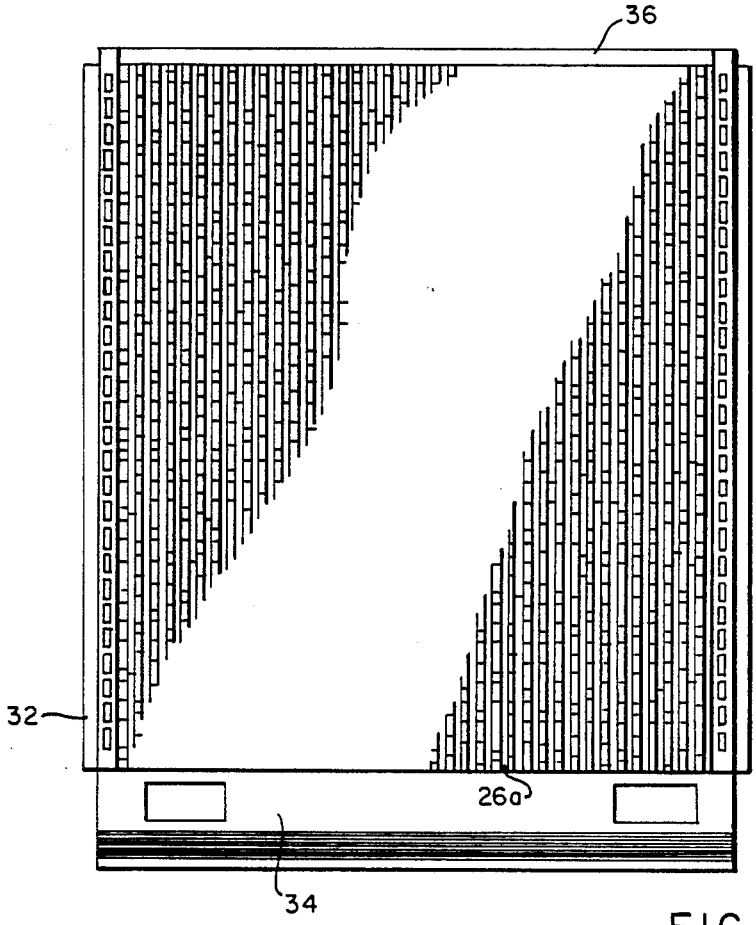
FIG. 2 is a side elevation view illustrating the decorative cover material of the wall panel of this invention.

In the embodiment of FIG. 5, the urethane foam-backed fabric is provided with a textured appearance in the form of a relief design. This relief design is formed by a process similar to that disclosed in U.S. Pat. No. 4,400,422 issued to Colamco, Inc. of Columbus, Ohio. This textured decorative design, as also illustrated in FIG. 2, can be of any preselected geometric design and is formed by heat setting the decorative design in the fabric-covered urethane foam by compressing and heat setting the urethane foam **28*a* between the fabric 26*a* and a backing material 44. This forming is accomplished between a full contact female mold form and a flat heated press which initiates the foaming reaction and cures the resultant foam 28*a*** while securing the fabric cover and backing material to the foam thus permanently setting the geometric, relief design in the fabric.

In manufacturing the wall panel of this invention, the frame 12 is placed on a flat surface and a slurry of prefoamed material of suitable quantity is poured into the area confined by the frame. In preparing the core material, a thoroughly mixed slurry of powdered gypsum (Hydro-Perm or Hydro-Cal C) manufactured by U.S. Gypsum Corp. is combined with a latent acrylic latex polymer, warm water and pregenerated foam in a continuous slurry mixer. The mixer is preferably comprised of a rotor, in the form of a helical screw, disposed along the axis of a tubular chamber into which the ingredients to be mixed are continuously fed. The helical screw disposed along the length of the chamber moves the mixture through the chamber to its outlet. The slurry which is mixed for about 5 seconds and preferably not less than 2 seconds is discharged from the mixing chamber and allowed to foam and set within the confines of the frame 12. A typical example of a suitable mixture is 47 parts by weight calcined gypsum, 1.4 parts by weight acrylic latex polymer, 39.1 parts by weight warm water and 12.5 parts by weight of pregenerated surfactant foam. The urethane foam-backed fabric is then secured to the opposite sides of the smooth surface, hardened, porous gypsum foam core material and adjacent frame members to complete the basic wall panel structure. Subsequently, the slotted standards 32 are secured to each side rail 16, the electrical channel 34 is secured to the bottom rail 18 and the top cap 36 is secured to the top rail 14.

When a panel of the construction illustrated in FIGS. 1 and 3 is fabricated, only sufficient slurry material is initially poured into the frame to fill the frame to approximately its mid-point with foam. A Surmat-fiberglass blanket is then placed on the flanges 24 and sufficient slurry material poured onto the Surmat-fiberglass septum to fill the other half of the panel core with gypsum foam.

As will be apparent from the foregoing, a decorative, lightweight, sound absorbing, fire resistant space-dividing wall panel of totally new construction has been provided which evidences the lightweight, sound absorbing and fire resistant characteristics of a foamed gypsum not heretofore considered with respect to space-dividing wall panel structures of the movable partition type.

What is claimed is:

1. A space-dividing wall panel for use in open office space-dividing wall panel systems, said wall panel comprising:

a rectangular outer frame defining the top, bottom and side edges of said panel;

a foamed in-place gypsum foam filler filling the space surrounded by said outer frame and constituting a panel core having planar lateral surfaces; and a decorative fabric cover covering said planar surfaces of said core and secured to said frame.

2. The space-dividing wall panel according to claim 1, wherein said decorative fabric cover includes a relief design therein.

3. The space-dividing wall panel according to claim 1, wherein said rectangular outer frame is of rectangular tubular construction having a flat inner surface defining the perimeter of said space and said core.

4. The space-dividing wall panel according to claim 3, wherein a rigid septum is connected to the inner surfaces of said outer frame dividing the space surrounded by said outer frame and said foamed in-place gypsum foam fills the remainder of said space on each side of said septum.

5. The space-dividing wall panel according to claim 1, wherein said decorative cover includes a fabric outer surface having a polyurethane backing and a relief design therein.

6. The space-dividing wall panel according to claim 1, wherein said rectangular outer frame is C-shaped in cross-section and includes elongated leg portions which extend into said gypsum foam.

7. A space-dividing wall panel for use in an open office space-dividing wall panel system, said wall panel comprising:

an outer frame having top, bottom and side rails;

a core material filling the space defined by said outer frame, said core material having substantially planar outer surfaces; and a decorative fabric cover material covering said planar outer surfaces of said core material, said decorative fabric cover having a preselected relief design therein.

8. The space-dividing wall panel according to claim 7, wherein said decorative fabric cover material has a polyurethane backing thereon.

9. The space-dividing wall panel according to claim 7, wherein said core material is a foamed in-place gypsum foam.

10. The space-dividing wall panel according to claim 9, wherein a septum is connected to the inside surface of said frame rails dividing said core into two separate halves.

11. The space-dividing wall panel according to claim 9, wherein said frame rails are C-shaped in cross-section and include elongated leg portions which extend into said gypsum foam.

* * * * *